US006530109B1

(12) United States Patent
Cassedy

(10) Patent No.: US 6,530,109 B1
(45) Date of Patent: Mar. 11, 2003

(54) PAINT ROLLER CLEANING AND RECONDITIONING TOOL

(76) Inventor: Victor C. Cassedy, HC 69 Box 243, White Sulphur Springs, WV (US) 24986

( * ) Notice: Subject to any disclaimer, the term of this patent is extended or adjusted under 35 U.S.C. 154(b) by 14 days.

(21) Appl. No.: 09/826,506

(22) Filed: Apr. 4, 2001

Related U.S. Application Data

(60) Provisional application No. 60/194,736, filed on Apr. 5, 2000.

(51) Int. Cl.[7] ..... B05C 21/00
(52) U.S. Cl. ..... 15/236.03; 15/104.04
(58) Field of Search ..... 15/104.04, 160, 15/236.03; 134/900

(56) References Cited

U.S. PATENT DOCUMENTS

| | | | | | |
|---|---|---|---|---|---|
| 1,253,363 | A | * | 1/1918 | Farr et al. | 15/104.04 X |
| 1,585,939 | A | * | 5/1926 | Roepke | 15/160 |
| 2,761,165 | A | | 9/1956 | Krzanowski | 15/236.03 |
| 2,825,916 | A | | 3/1958 | Basala, Jr. | 15/236.03 |
| 2,856,622 | A | | 10/1958 | Jacobsen | 15/105 |
| 2,961,683 | A | | 11/1960 | Meyer | 15/236.03 |
| 3,170,182 | A | | 2/1965 | Burian | 15/142 |
| 3,373,456 | A | | 3/1968 | Dalton | 15/1 |
| 3,707,740 | A | * | 1/1973 | Demers | 15/236.03 |
| 4,133,070 | A | * | 1/1979 | Litt | 15/104.04 X |
| 4,324,018 | A | | 4/1982 | Olsson | 15/236.03 |
| 4,995,749 | A | * | 2/1991 | Gornik | 134/900 X |
| 5,272,782 | A | | 12/1993 | Hutt | 15/105 |
| 5,515,567 | A | * | 5/1996 | Washburn | 15/236.03 X |
| D386,372 | S | | 11/1997 | Weiss | D8/14 |
| D386,857 | S | | 11/1997 | Lawrence | D32/46 |

FOREIGN PATENT DOCUMENTS

| | | | | |
|---|---|---|---|---|
| DE | 505683 | * | 8/1930 | 15/160 |
| DE | 2721212 | * | 11/1978 | 15/236.03 |
| GB | 12576 | | of 1904 | |
| GB | 793180 | | 4/1958 | |
| GB | 2270464 | | 3/1994 | |
| GB | 876 | * | of 1913 | 15/160 |

* cited by examiner

*Primary Examiner*—Mark Spisich

(57) ABSTRACT

A device for cleaning and re-conditioning the nap of a paint roller includes a circular collar with a plurality of resilient fingers. The fingers define a circular opening through which a paint roller is inserted. During back and forth movements of the device the resilient fingers penetrate the nap of the paint roller to remove excess paint while at the same time lifting and reconditioning the roller nap.

1 Claim, 4 Drawing Sheets

PAINT ROLLER CLEANING AND RECONDITIONING TOOL

CROSS-REFERENCE TO RELATED APPLICATIONS

This application claims priority under 35USC 119 to Provisional Application Serial No. 60/194,736, filed Apr. 5, 2000.

BACKGROUND OF THE INVENTION

The invention pertains to the field of painting and is directed to a paint roller cleaning tool. More specifically, the invention relates to a combined cleaning and reconditioning tool particularly adapted to remove excess paint from paint absorbing rollers and to raise the nap of dry rollers. The common practice of cleaning and rinsing paint rollers is a very tedious and time-consuming task. The conventional practice of squeezing and rubbing of rollers while cleaning leaves the nap in a flattened or uneven condition after drying. This practice not only delays the drying time but also leaves the nap in a matted condition which requires it to be reconditioned before re-use of the roller. There is a need by painters, both professional and others, for an efficient paint roller=cleaning tool that leaves the roller nap in a raised attitude after cleaning and also reconditions the nap of dry rollers quickly prior to re-use.

Most paint roller cleaning devices do not address nap reconditioning and those that do have several disadvantages. One major disadvantage is time-consuming delays due to devices having complex parts that can become loose, lost or broken. Another disadvantage in regards to devices that employ arcuate shapes to condition the nap is that they fail to embrace the entire periphery of the roller during use. Since dry rollers need an occasional nap reconditioning another disadvantage is that many prior devices are designed only to remove excess paint from wet rollers.

BRIEF SUMMARY OF THE INVENTION.

This invention is directed to a hand tool for cleaning and reconditioning paint rollers. The primary object of this invention is to provide a very effective but simple tool to clean paint from a wet roller while at the same time to re-condition the nap of the roller. Another object of this invention is to provide a tool for reconditioning the flattened or uneven nap of dry rollers in quick fashion prior to use

BRIEF DESCRIPTION OF THE INVENTION

DETAILED DESCRIPTION OF THE INVENTION

The paint roller and reconditioning tool may be a single body device. The device may have a single handle for quick and easy operation. A primary feature the invention comprises the annular cleaning and conditioning section. The section includes a substantially circular collar with a multitude of thin but firm and resilient fingers, which project radially inwardly from the collar and terminate to form a substantially circular opening. As a paint roller passes through this opening the fingers stretch, pull, push and penetrate the roller nap. This wiping action eliminates a great amount of paint and leaves the nap in a very good condition for drying and re-use.

Figure 1:
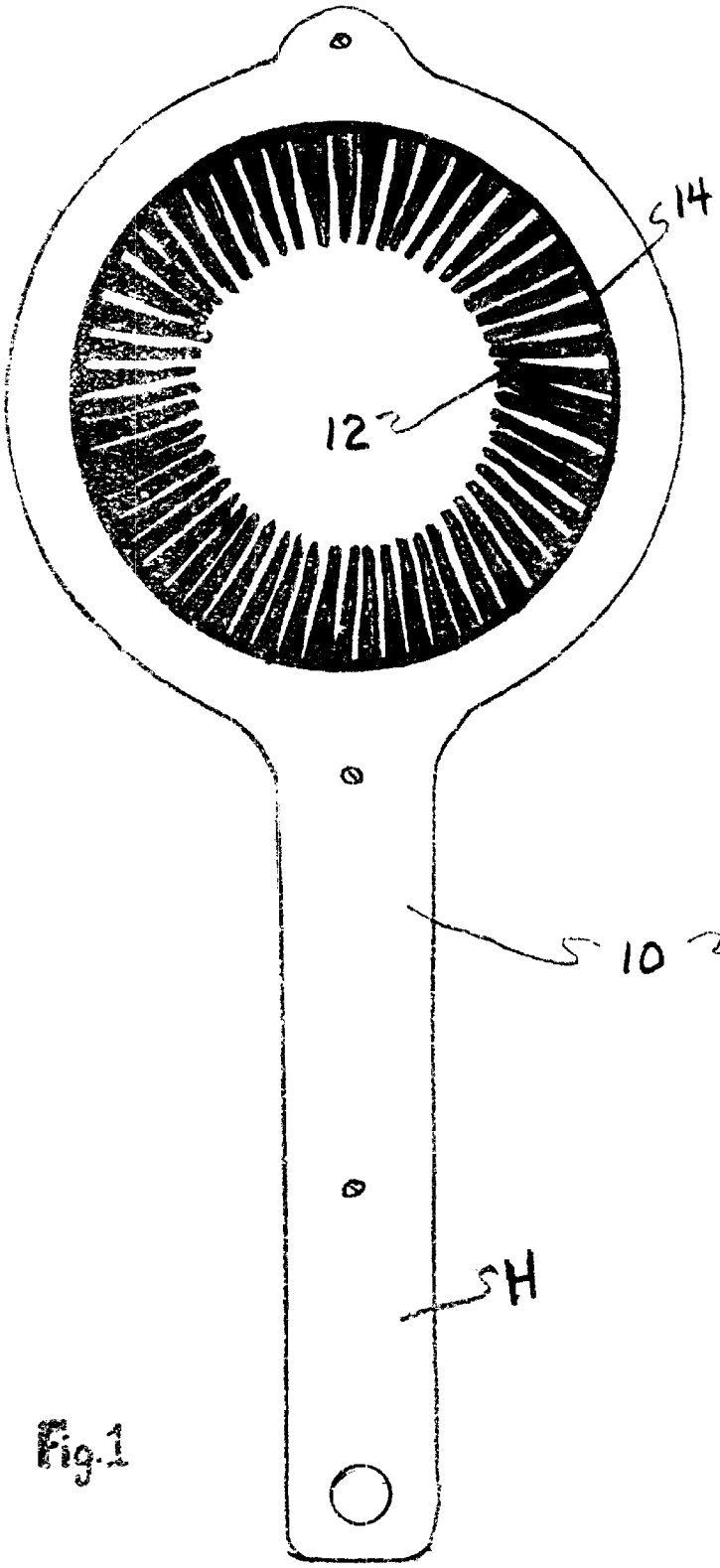
FIG. 1 is the plan view of the paint roller cleaning and reconditioning tool of the invention.
Figure 2:
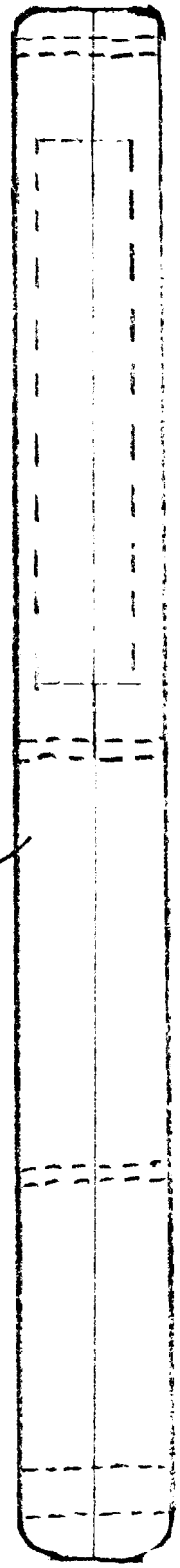
FIG. 2 is a side view of the tool of FIG. 1
Figure 3:
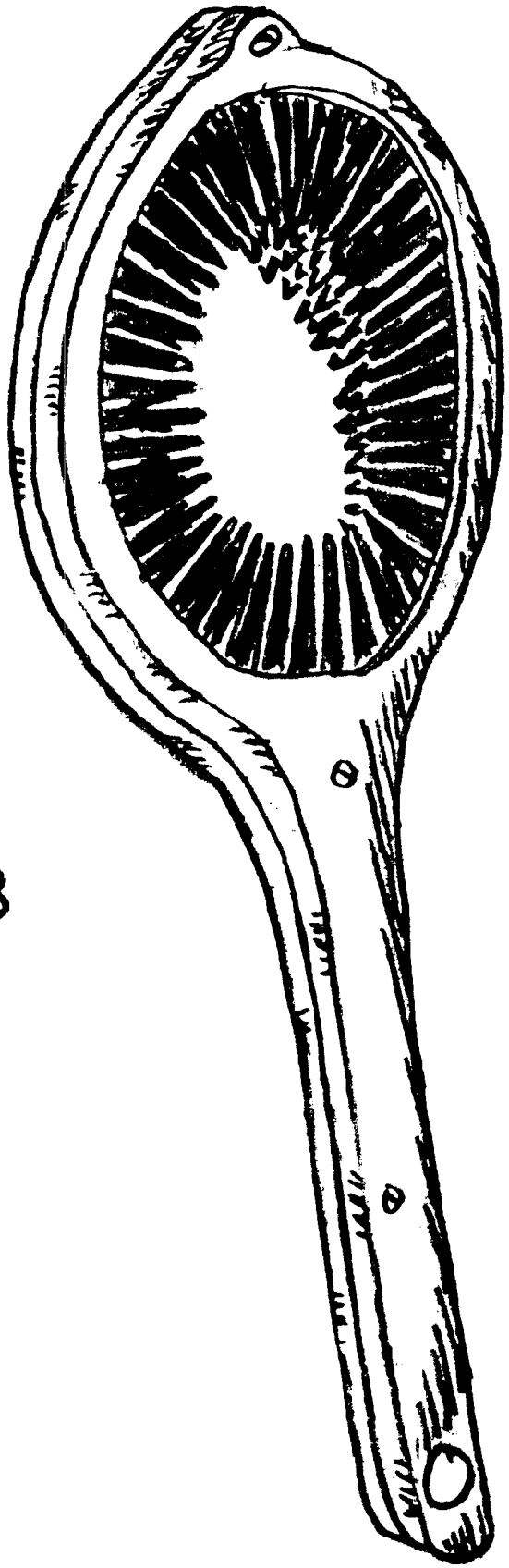
FIG. 3 is a perspective view of the paint roller cleaning and reconditioning tool illustrating the several rows of a number of resilient fingers.

The tool 10 as shown in FIG. 1 and FIG. 2 is a single body device comprising a rounded handle H, the head portion of tool 10 includes a circular shaped collar having surfaces. Projecting radially inwardly from inside surfaces of said collar is a number of firm, yet flexible fingers 12. The fingers 12, are very narrow and cone shaped and project inwardly to describe a circular opening, said opening sized for passage of a paint roller and the fingers arranged to penetrate, push, pull, stretch and lift the nap during the back and forth motion used while cleaning and/or reconditioning rollers.

The preferred choice of material to construct tool 10 is any one of the many available durable thermoplastics. The collar 14 and fingers 12 are preferably nylon although a metal such as copper or steel could be used. It is understood that the tool 10 could easily be constructed with other types of material known to one of skill in the art. For example, the original tool used wire for the handle and embroidery hoop rings for the circular shaped collar portion. The flexible fingers were cut from a curry comb brush and attached to inner surface of the collar with glue and fishing line.

Another simple way to construct tool 10 is to use a jig saw while cutting shape of tool 10 from wood and any similar curry comb or brush could also be attached with glue and fishing line or even by screws.

Figure 7:
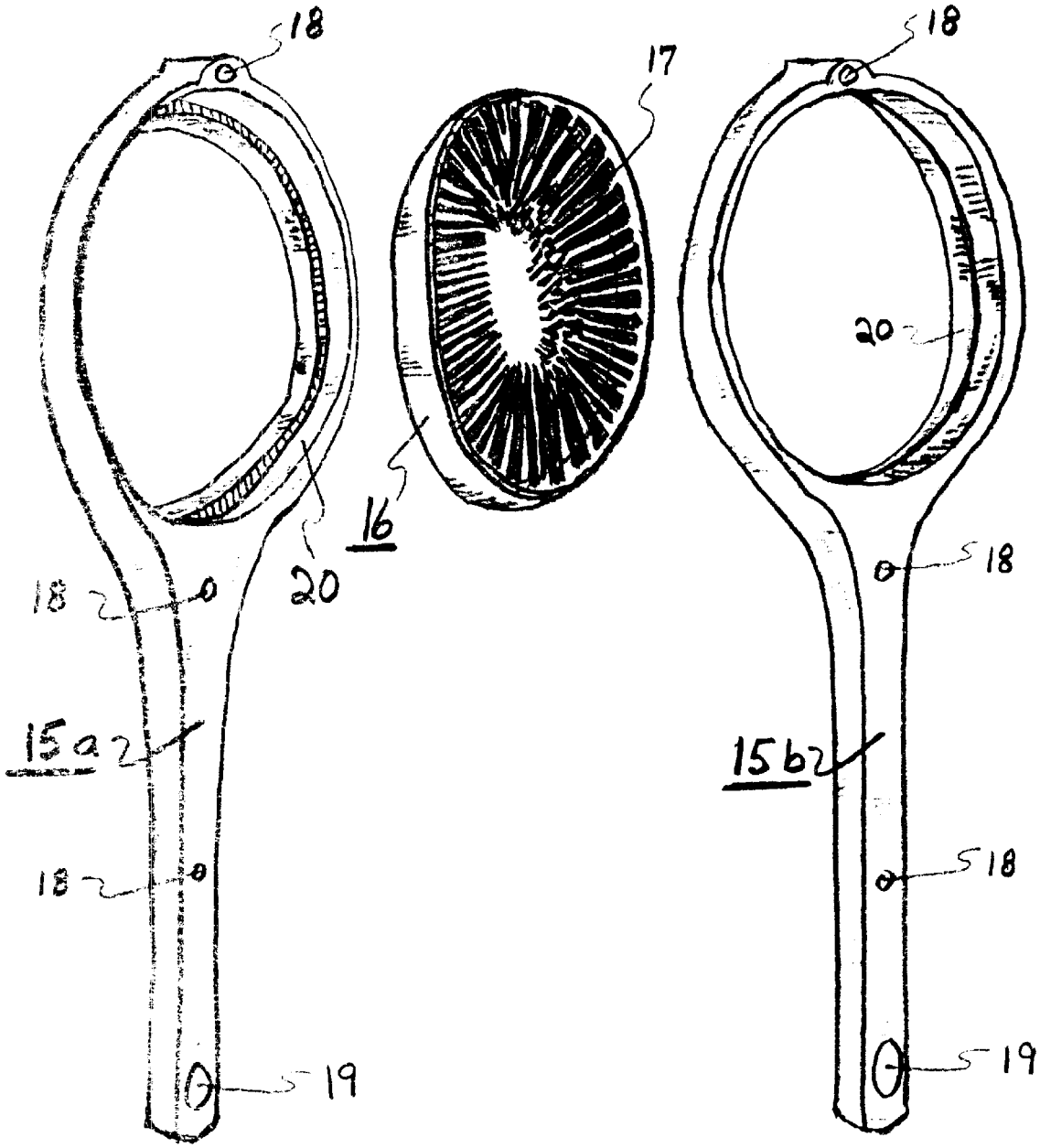
FIG. 7 is an exploded view of a second embodiment of the invention.

In the embodiment of FIG. 7, the body portion of the tool comprises first and second mating portions 15*a*, 15*b*. The collar portion 16 including fingers 17 is captured in groove 20 in the upper circular head portion of the tool. The mating portions preferably are made of molded plastic and secured together by means of screws or bolts inserted through the holes 18. Alternatively the mating portions may be secured together by glue or epoxy. A hole 19 is provided for hanging the tool during non-use. The two piece construction allows for replacement of the collar and fingers if said fingers wear out or if a collar and fingers of different material or size is desired.

Figure 4:
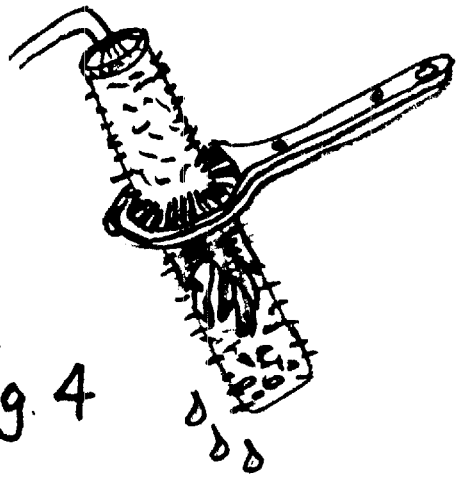
FIG. 4 illustrates the extraction of excess paint on outer perimeter of a paint roller.
Figure 5:
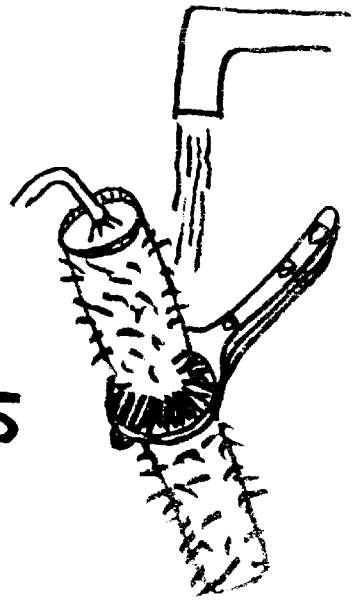
FIG. 5 illustrates the tool being used for the simultaneous cleaning and nap reconditioning of rollers during the common practice of rinsing paint rollers.
Figure 6:
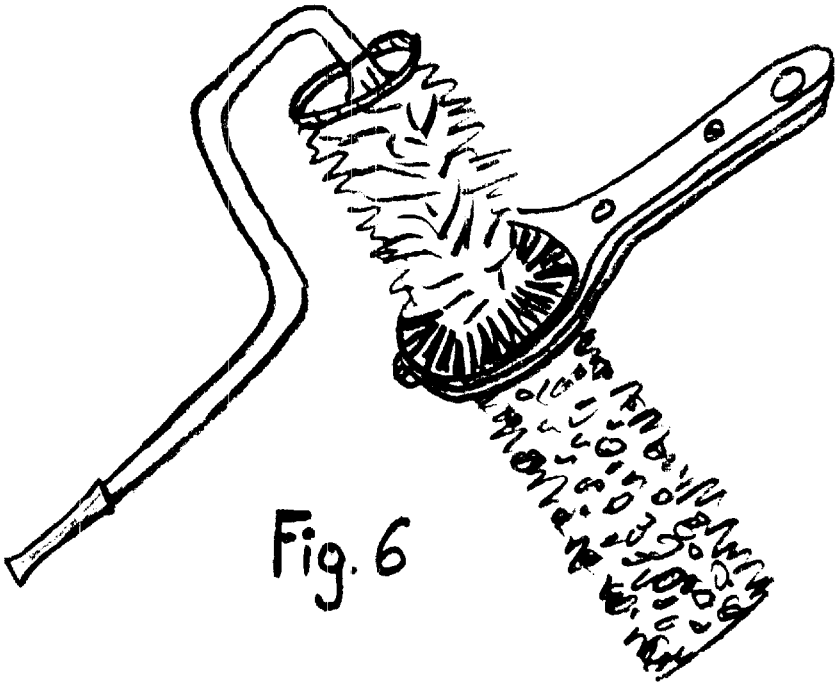
FIG. 6 illustrates the tool used to recondition the nap of a clean dry roller.

The operation of the tool may be understood from FIGS. 4–6 of the drawings. FIG. 4 illustrates the use of the tool to remove excess paint from a wet roller while FIG. 5 illustrates the use of the tool during the cleaning of the roller. In practice, the opening of the tool is inserted along the handle portion of a paint roller holder and then axially along the paint roller proper to effect paint removal and cleaning. FIG. 6 illustrates the reconditioning the nap of a dry roller by moving the tool axially back and forth along the surface of the roller.

While there have been shown and described several preferred embodiment of the Paint Roller Cleaning & Reconditioning Tool, it is understood that changes in structure, material, size and shape can be made by those skilled in the art without departing from the invention. The invention is described in the following claims.

I claim:

1. A paint roller cleaning and conditioning tool comprising: an annular collar portion including a plurality of finger elements extending radially inward from an inner surface thereof, the free ends of the finger elements defining a circular opening adapted for receiving a paint roller therein;

a body member including first and second mating portions, each of the mating portions including a circular head portion and an elongated handle portion extending therefrom, each circular head portion comprising a circular opening bounded by a circular groove;

wherein the annular collar portion is adapted to be secured within the grooves of the first and second mating portions and the mating portions including means for securing them together and for thus securing the annular collar portion within and between the circular head portions of the body member; and whereby the roller may aligned with the circular opening defined by the finger elements and the tool then moved back and forth along the roller such that the finger elements penetrate and lift the nap of the roller.

* * * * *